US010376913B2

(12) United States Patent
Coates

(10) Patent No.: US 10,376,913 B2
(45) Date of Patent: Aug. 13, 2019

(54) SYSTEM FOR SPRAYING THE INSIDE OF CAN BODIES

(71) Applicant: CROWN PACKAGING TECHNOLOGY, INC., Alsip, IL (US)

(72) Inventor: Michael Jonathan Coates, Otley (GB)

(73) Assignee: Crown Packaging Technology, Inc., Alsip, IL (US)

( * ) Notice: Subject to any disclaimer, the term of this patent is extended or adjusted under 35 U.S.C. 154(b) by 499 days.

(21) Appl. No.: 15/119,009

(22) PCT Filed: Mar. 20, 2014

(86) PCT No.: PCT/EP2014/055570
§ 371 (c)(1),
(2) Date: Aug. 15, 2016

(87) PCT Pub. No.: WO2014/147163
PCT Pub. Date: Sep. 25, 2014

(65) Prior Publication Data

US 2017/0036229 A1 Feb. 9, 2017

(30) Foreign Application Priority Data

Mar. 21, 2013 (GB) ..... 1305213.9

(51) Int. Cl.

| | |
|---|---|
| ***B05B 13/02*** | (2006.01) |
| ***B05B 13/06*** | (2006.01) |
| ***B05D 1/02*** | (2006.01) |
| ***B05D 7/22*** | (2006.01) |

(52) U.S. Cl.
CPC ..... *B05B 13/0242* (2013.01); *B05B 13/0645* (2013.01); *B05D 1/02* (2013.01); *B05D 7/227* (2013.01); *B05D 2202/00* (2013.01)

(58) Field of Classification Search
None
See application file for complete search history.

(56) References Cited

U.S. PATENT DOCUMENTS

| | | | | |
|---|---|---|---|---|
| 4,246,300 | A * | 1/1981 | Jensen | B65C 9/04 118/318 |
| 6,146,695 | A | 11/2000 | Frey | |
| 2007/0017440 | A1 | 1/2007 | Tang et al. | |

FOREIGN PATENT DOCUMENTS

| | | | |
|---|---|---|---|
| DE | 19811873 | A1 | 9/1988 |
| DE | 4333859 | A1 | 4/1995 |
| GB | 104464 | A | 3/1917 |
| WO | WO 2009/143134 | A2 | 11/2009 |

* cited by examiner

*Primary Examiner* — Nathan T Leong
(74) *Attorney, Agent, or Firm* — BakerHostetler

(57) ABSTRACT

A system for spraying a coating such as lacquer on the internal surface of a can body (2) comprising vacuum chuck gears (42) for each vacuum chuck (16). The vacuum chucks hold the can body as it rotates about a main process turret (10) and to a spray station (32, 34). A ring gear rotates independently of main turret rotation and further gearing connects the ring gear to a vacuum chuck drive motor (11). The spray system provides tight process control and allows flexibility of process revolutions or use of higher machine production speed.

7 Claims, 6 Drawing Sheets

SYSTEM FOR SPRAYING THE INSIDE OF CAN BODIES

CROSS-REFERENCE TO RELATED APPLICATIONS

This application is the National Stage of International Application No. PCT/EP2014/055570, filed Mar. 20, 2014, which claims the benefit of EP application number 1305213.9, filed Mar. 21, 2013, the disclosures of which are incorporated herein by reference in their entireties.

TECHNICAL FIELD

This invention relates to a spray machine. In particular, it relates to a spray machine for spraying a coating onto the internal surface of a can body for food or beverage products.

BACKGROUND ART

Can bodies are typically formed from a sheet of metal which is rolled into a tube shape. The join in the tube is closed by a weld, for example. The side seam formed by the weld is often referred to as a side stripe. Can "ends" are fixed to a first end of the tube, the resultant can body is then filled and closed at the opposite end to produce a so-called three-piece can. Traditionally, three-piece cans are mainly used for the packaging of food products and range in diameter from 52 mm to 153 mm and over a height range of 38 mm to 178 mm.

Alternatively, a can body is formed by a drawing technique in which a punch forces metal through a die or series of dies to form a can body with an integral base or "bottom". Sometimes, these can bodies are stretched further to increase the side wall by a technique known as "wall-ironing". The drawn or drawn and wall-ironed can body is then filled and closed with a single end to produce a so-called two-piece can. Although two-piece cans are also used for the packaging of food products, largest numbers of two-piece cans are used for still and carbonated beverages. Two-piece beverage cans range in diameter from 52 mm to 84 mm and range in height from 88 mm to 204 mm.

It is well known to coat an internal side strip on a welded sheet metal pipe. U.S. Pat. No. 6,146,695 (FREY) is one example of this in which a thermoplastic material is melted and applied by a nozzle in metered quantities over the longitudinal weld. This patent also notes that clean sterilisation-resistant internal covering of the weld is of great importance in tinned metal cans used for the foodstuff industry. Any coating applied to such "food cans" also needs to be resistant to metal forming processes as well as any processing of the filled can. In this Frey patent, thermoplastic "hotmelt" material such as polyester is recommended as for its strength and foodstuff tolerance. The protective film in this patent is applied by a nozzle directly on the weld seam only. The tinned metal used at the time of filing this patent would have been 0.16 mm to 0.2 mm.

A lacquer spray machine for applying and evenly distributing a lacquer coating over the entire internal surface of a can body for a two piece can, i.e. having a side wall and integral base, was known since 2007 from CarnaudMetalbox "3200" spray machine, for example. The 3200 machine at that time applied interior lacquer to two piece can bodies ranging in size from 15 cl "202" to 50 cl "211". 202 is 52 mm diameter, and the height of a 15 cl 202 can body is 88 mm. Similarly, 211 is 66 mm diameter, and the height of a 50 cl 211 can body is 168 mm.

In the 3200 machine, cans (i.e. can bodies) are received by an infeed assembly. Cans released by the infeed are positioned in "pockets" supplied by vacuum to base pads on a rotary turret. On the turret, cans are received by a turret can carrier and drawn onto the vacuum base pad (referred to below as "vacuum chuck").

The 3200 machine has a spray station in which lacquer is applied to the inside of can bodies. In this 3200 machine, cans are indexed into the spray station for application of spray for a selected period of time. This spray machine has a pulley and belt drive. A can base pad pulley makes contact with a spinner belt that rotates the can at high speed, typically 2000 rpm to 2400 rpm. At 2000 rpm, there would be 3 can wraps, at 2400 rpm, 4 wraps would be required. A "can wrap" is a term for one can revolution whilst coating is being applied. During the spinning of the cans, a spray gun is activated and coating is applied by spraying and evenly distributing lacquer over the interior of the can.

Spray time is limited by gun reaction time; weight of coating media which the gun is capable of applying in the time period; acceleration of the vacuum base pad to desired speed through contact with its associated spinner belt; machine sensor reaction time; confirming the turret is in a spray position; and checking that the chuck is at the correct speed.

A conventional machine such as the 3200 is shown in FIGS. 1 to 3. Cans (i.e. can bodies) 2 pass along infeed tracking 4 and are fed in turn to pockets 6 of a main turret 10. Production speed is related to spray time and coating weight. Turret 10 is connected to and driven by a main turret index box 12 (FIG. 2). The turret motion is index-dwell-index etc. with spray coating occurring in the dwell period. At 350 cans per minute ("cpm"), an index box cam gives time per can of 0.171 seconds (60/350).

The index box cam revolves one revolution per can. The 3200 cam periods are 150° degrees for index movement and 210° degrees for dwell. Index movement time for this machine is therefore 150/360×60/350=0.071 seconds. Dwell time is 210/350×60/360=0.100 seconds.

Vacuum chucks 16 are mounted on the main turret 10 and arranged on a pitch circle diameter or "PCD" about the main turret centre 14. Each vacuum chuck 16 is equipped with a chuck spinner pulley 18 which receives drive through contact with a chuck spinner drive belt 20. The chuck spinner pulleys 18 move into and out of contact with the chuck spinner drive belt 20 during one full rotation of the main turret. For a 12 pocket machine this is 2.06 seconds (60/350×12) and for a 6 pocket machine this is 1.03 seconds. The main turret index box 12 and chuck spinner drive motor 22 plus idler pulley 23 are static mounted to the main frame 24, i.e. without allowing relative movement.

Finally it is noted that after application of the internal coating, cans are passed to a discharge turret 36 and then along discharge trackwork 38.

This 3200 machine is intended to operate at up to 350 cpm for a 12 pocket machine or 420 cpm for a 6 pocket machine. A problem with this machine is that the belt is often contaminated by coating due to over-spray. Further problems include loss of friction between spinner pulley 18 and belt 20, and loose (i.e. relaxed) control of wraps.

Spray machine station 30 comprises chuck spinner drive belt 20, chuck spinner motor 22 and spray gun 32 (which is mounted on support frame 34). Section X-X of FIG. 2 and enlarged view (FIG. 3) of the chuck spinner belt 20 show the spray machine station 30 and process area in more detail. Also visible in this section are main turret index box 12 and its associated index box drive motor 11. Hub 25 provides static mounting for a vacuum manifold (26) which supplies timed vacuum service to the vacuum chucks.

In this conventional machine, debris due to wear of the chuck spinner drive belt 20 contaminates the can 2 and spray process area. Clearly cans which are contaminated in the spray machine are rejected from the process. In addition, friction drive between the chuck spinner drive belt and chuck spinner pulley is unreliable such that skidding occurs. As a result, the number of can process revolutions during spraying has a degree of uncertainty, which limits machine production speed to 350 cpm for a 12 pocket machine or, in situations where can quality specification is less rigid, to 420 cpm for a 6 pocket machine as noted above.

The spray machine of the present invention seeks to eliminate contamination of the spray process, while enabling high speed production of cans (i.e. can bodies) with fully coated interiors and achieving tight can coating specifications. These can coating specification parameters include coating weight, distribution and metal/aluminium exposure.

SUMMARY OF INVENTION

According to the present invention, there is provided a system for spraying the inside of can bodies comprising a spray station and a main rotary turret; the main rotary turret being connected to and driven by an indexing device; one or more spray guns on a spray gun support frame; vacuum chucks arranged circumferentially around the turret for holding can bodies; characterised by: each vacuum chuck having a vacuum chuck gear; each vacuum chuck gear being in constant mesh with a ring gear; the ring gear being rotatably mounted on a hub; the hub being a static machine element which is mounted both back to a main frame and about the centre of the main rotary turret; and constant mesh gearing which connects the ring gear to a vacuum chuck drive motor.

The indexing device may be an index box or a servo motor and gearing. The gearing may be in a gearbox. The index box may be a mechanical index box. The servo motor may function as an indexing servo motor.

The elimination of the prior art belt drive thus prevents contamination of the spray process. It has previously not been considered possible to use a gear drive for process stations at or around the main process turret due to not only space constraints but also the ability of the gear driven chuck to be independent of the main turret which is held stationary during the spray cycle.

Advantageously the vacuum chuck drive motor is variable speed control so as to be able to tune the wraps, and respond to line production speed variation.

Generally, the vacuum chuck drive motor is static mounted to the main frame. Typically, the vacuum chucks are arranged on a pitch circle diameter about the centre of the main turret.

The spray system may further comprise one or more ring gear bearings arranged between the ring gear and the hub. Gears may be steel or non-ferrous material or plastic. Advantageously the gear system is self-lubricating, i.e. with no grease or oil system required.

According to another aspect of the present invention there is provided a method of spraying a coating over substantially all of the interior of a can body, the method comprising: indexing one or more vacuum chucks for holding can bodies about the centre of a main rotary turret; rotating individual vacuum chucks about their own axes; providing a vacuum chuck gear for each vacuum chuck, each vacuum chuck gear being in constant mesh with a ring gear; mounting the ring gear on a hub for free rotation; providing one or more hubs statically mounted about the centre of the main turret; statically mounting each hub back to a main frame; and connecting the ring gear to a vacuum chuck drive motor via constant mesh gearing; indexing a can held by a vacuum chuck to a spray station; and spraying the interior of the can body at the spray station.

DESCRIPTION OF EMBODIMENTS

Figure 1:
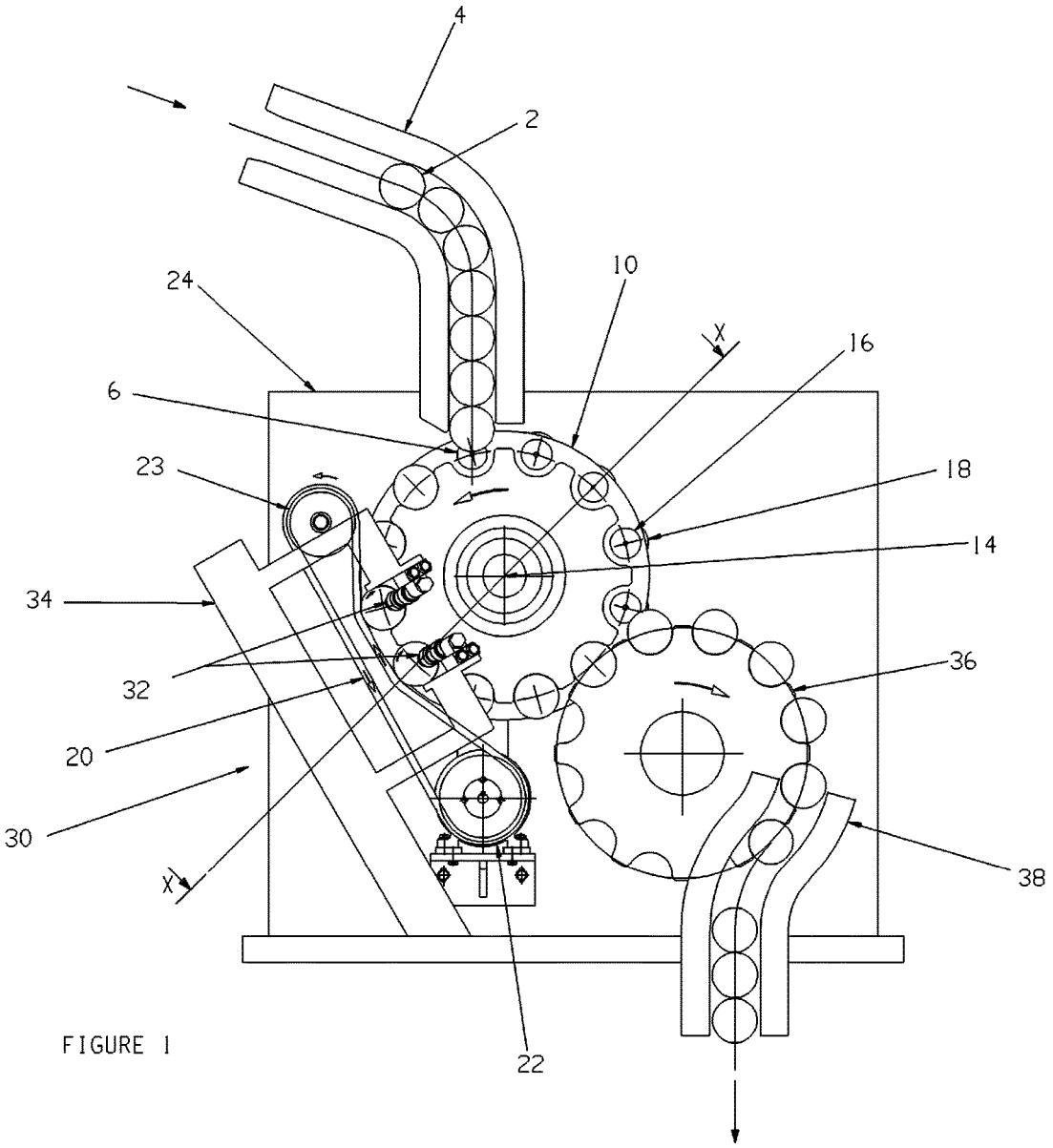
FIG. 1 is a schematic of a conventional prior art machine including a spray station.
Figure 2:
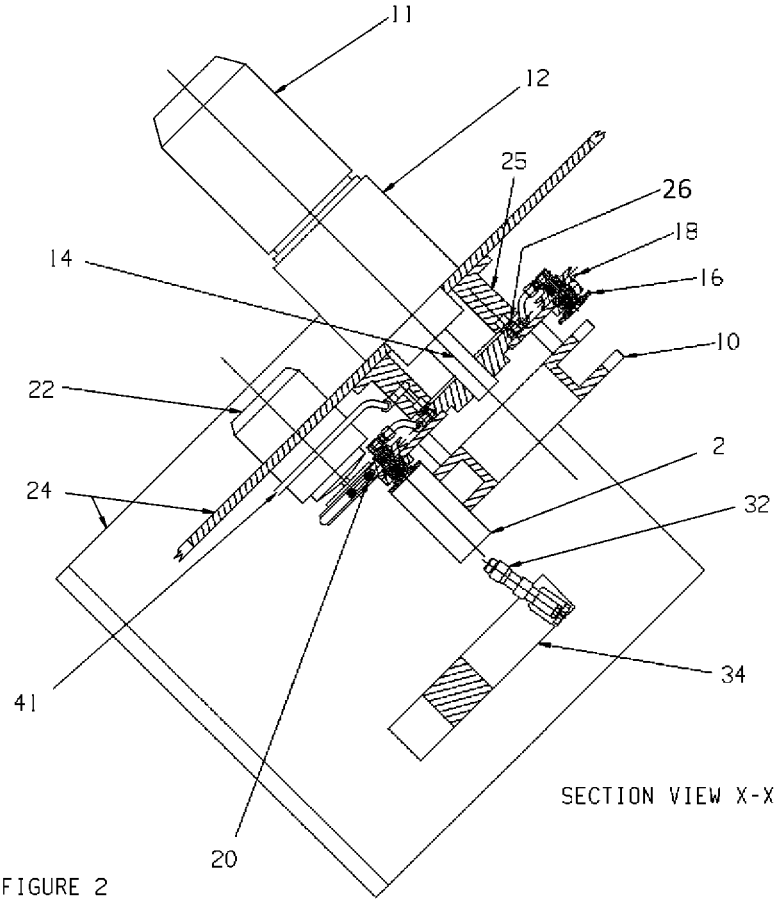
FIG. 2 is a section along X-X of FIG. 1.
Figure 3:
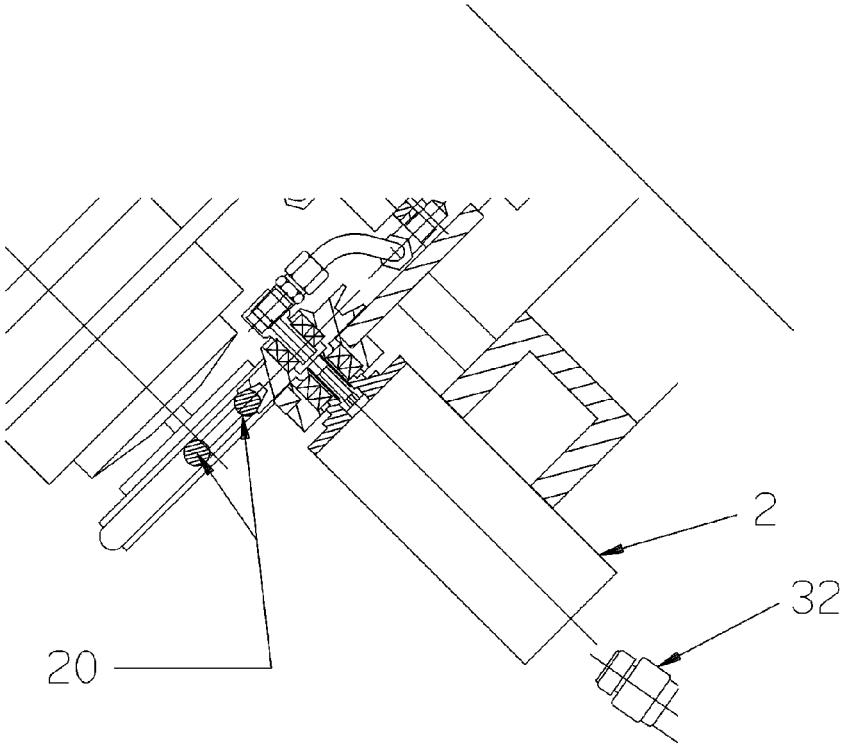
FIG. 3 is an enlarged view of the spray station of FIG. 2.
Figure 4:
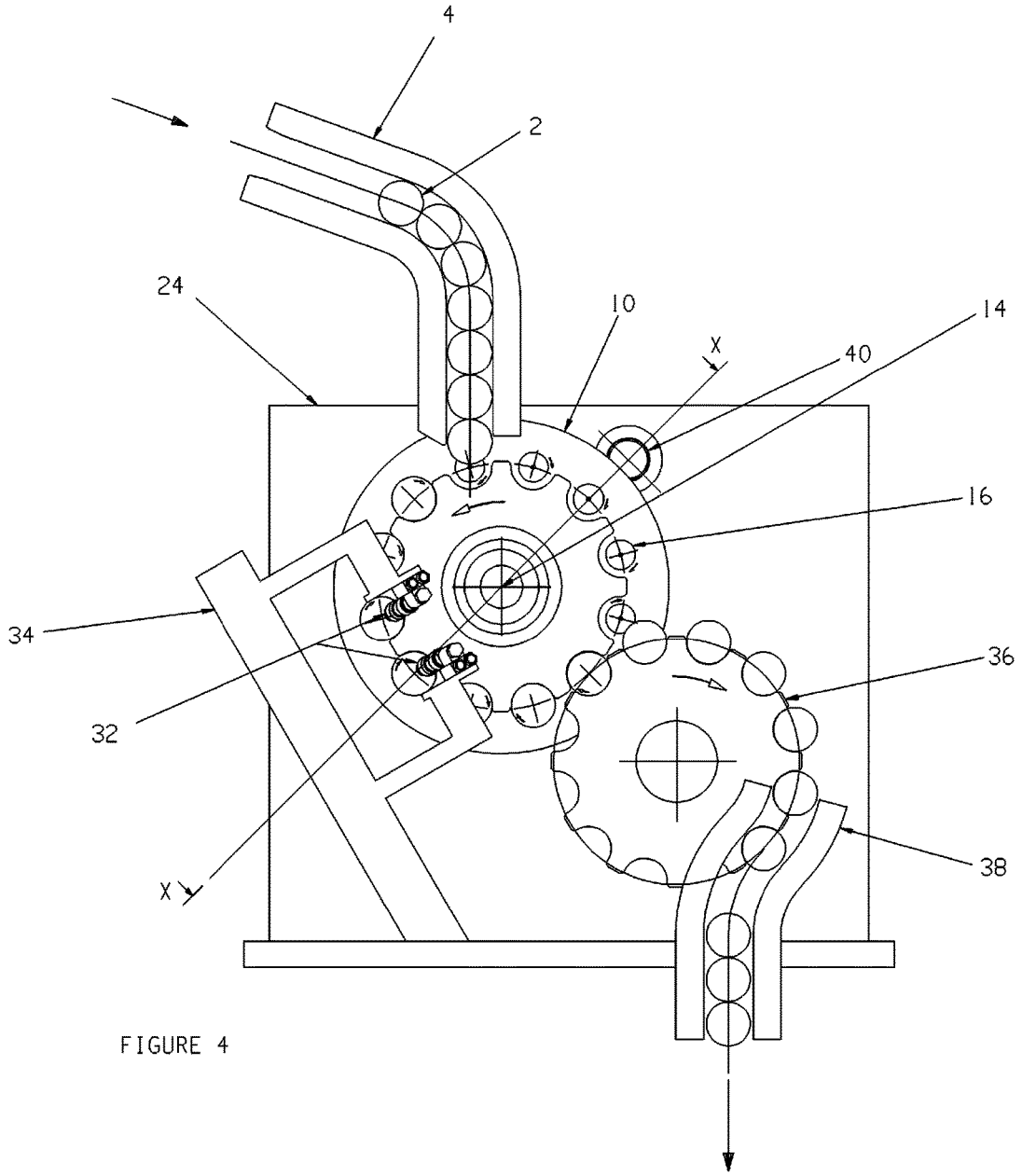
FIG. 4 is a schematic of a spray machine of the present invention.
Figure 5:
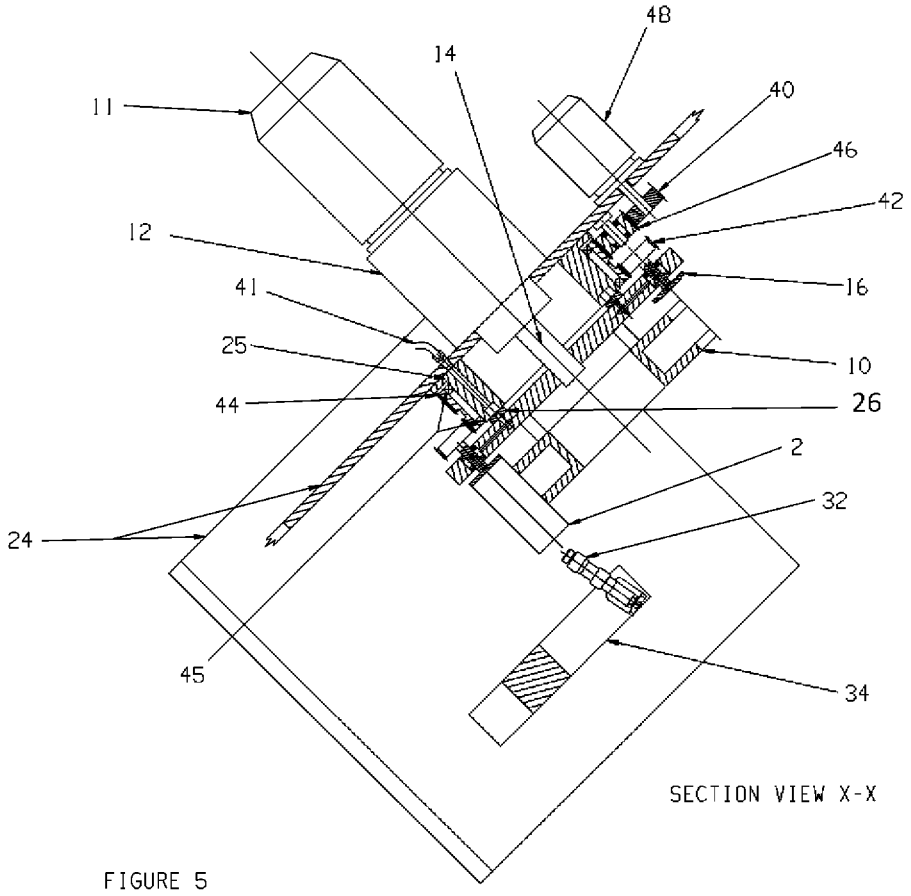
FIG. 5 is a section along X-X of FIG. 4.
Figure 6:
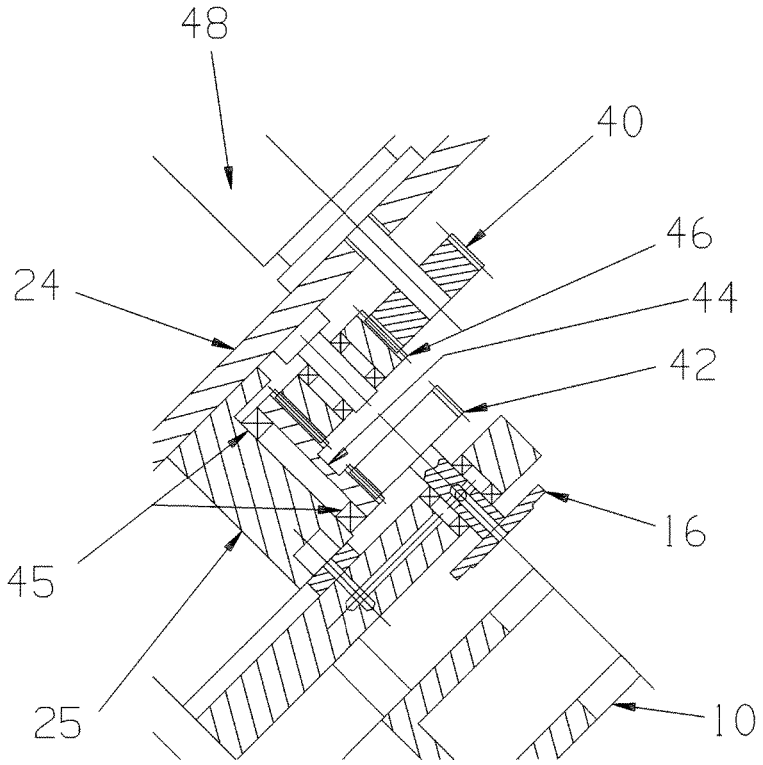
FIG. 6 is an enlarged view of the gear drive of FIG. 5.

In FIGS. 4 to 6, parts which are like with those of FIGS. 1 to 3 have been given the same reference numerals. In this way it is immediately apparent that the spray machine of the present invention does not include such features as a chuck spinner drive motor and pulley, idler pulley or chuck spinner drive belt. Instead, in FIG. 4 only a motor gear 40 is shown. Further features of the present invention are described in the following paragraphs.

The schematic of FIG. 4 shows that, like in the known machine, cans 2 are fed along infeed trackwork 4 to a main (process) turret 10. Cans are indexed to a spray station where a coating such as an internal lacquer is sprayed by a spray gun 32 mounted on a support frame 34. There is one spray gun per spray station with several spray stations mounted off the support frame. As in the known machine, cans are discharged via a discharge turret 36 and along trackwork 38.

The novel use of motor gear 40 becomes more clear in the section along X-X and enlarged view of FIGS. 5 and 6 respectively. The main turret 10 is connected to and driven by main turret index box 12 and its index box drive motor 11 which are mounted on one side of the main frame 24 as in the prior art, with a hub 25 on the other side of the frame 24. Vacuum chucks 16 are mounted on the main turret and arranged about a pitch circle diameter PCD about the main turret centre.

Of note in the present invention is not simply a chuck vacuum supply 41 which passes through the main frame 24, but more particularly a vacuum chuck gear (also referred to as a vacuum chuck drive gear) 42 one of which is supplied for each vacuum chuck 16. The vacuum chuck gears 42 are in constant mesh with a ring gear 44. To keep rolling friction low, rolling element bearings are used whatever material is used for the ring gear. A set of ring gear bearings 45 is arranged between the ring gear 44 and hub 25. The hub 25 is a static machine element which is mounted back to the main frame 24 and about the main turret centre 14. The hub provides additional static support on which to mount the ring gear bearing. The ring gear 44 is thus able to rotate independently of main turret rotation.

Further constant mesh gearing 46 connects the ring gear 44 to a vacuum chuck drive motor 48. Both the main turret index box 12 and the vacuum chuck drive motor 48 are static mounted to the main frame 24. The vacuum chuck drive motor 48 is variable speed control because the system needs to respond to variations in line production speed and keep can wraps constant.

Not only does the spray system of the present invention completely eliminate the prior art belt drive, but it also tightly controls vacuum chuck speed. In turn, the number of process revolutions during the spray process is tightly controlled, leading to flexibility to change the number of process revolutions for machine product range and exploitation of higher machine production speed. Further parameters relevant to internal can coating and therefore to the present invention include spray pressure, spray pattern, coating weight, spray media temperature, spray gun position and can size.

The invention has been described above by way of example only and changes are possible within the scope of the attached claims. For example, it is possible to use a system with 12 motors, one for each chuck and mounted on the turret although this would add a substantial amount of mass, increase radius of gyration and inertia, and so limit the selection of the indexing device. This option would also require a slip ring for obtaining power and any control signals between static elements and the 12 motors.

The invention claimed is:

1. A system for spraying the inside of can bodies comprising:

a spray station and a main rotary turret, the main rotary turret being connected to and driven by an indexing device, the indexing device being mounted to a main frame;

one or more spray guns on a spray gun support frame; and vacuum chucks arranged circumferentially around the turret for holding can bodies;

wherein each vacuum chuck has a vacuum chuck gear and each vacuum chuck gear is in constant mesh with a ring gear; the ring gear being rotatably mounted on a hub, the hub being a static machine element which is mounted to the main frame such that the hub is rotatably fixed relative to the main frame, the hub being positioned about a center of the main rotary turret, the main rotary turret being rotatable relative to the hub; and constant mesh gearing connects the ring gear to a vacuum chuck drive motor, such that each vacuum chuck is configured to be driven independently of the main rotary turret.

2. A system according to claim 1, in which the vacuum chuck drive motor is a variable speed control motor.

3. A system according to claim 1, in which the vacuum chuck drive motor is static mounted to the main frame.

4. A system according to claim 1, in which the vacuum chucks are arranged on a pitch circle diameter about the centre of the turret.

5. A system according to claim 1, further comprising one or more ring gear bearings arranged between the ring gear and the hub.

6. A system according to claim 1, in which the indexing device is a servo motor and gearbox.

7. A system according to claim 1, wherein the vacuum chuck drive motor is located on an opposite side of the main rotary turret with respect to the spray station.

* * * * *